United States Patent [19]

Carlin

[11] 4,010,085

[45] Mar. 1, 1977

[54] CATHODE ELECTROCATALYST

[75] Inventor: William W. Carlin, Portland, Tex.

[73] Assignee: PPG Industries, Inc., Pittsburgh, Pa.

[22] Filed: Apr. 28, 1976

[21] Appl. No.: 681,014

[52] U.S. Cl. ..... 204/128; 204/129; 204/290 R; 204/293; 204/242; 427/437; 427/438; 106/1

[51] Int. Cl.[2] ..... C25B 1/26; C25B 1/04; C25B 11/06

[58] Field of Search ..... 204/128, 129, 290 R, 204/293, 242; 427/437–438; 106/1

[56] References Cited

UNITED STATES PATENTS

| | | | |
|---|---|---|---|
| 2,755,241 | 7/1956 | Bagley et al. | 204/293 |

FOREIGN PATENTS OR APPLICATIONS

| | | | |
|---|---|---|---|
| 157,871 | 8/1921 | United Kingdom | 204/293 |
| 292,131 | 9/1929 | United Kingdom | 204/293 |

*Primary Examiner*—R. L. Andrews
*Attorney, Agent, or Firm*—Richard M. Goldman

[57] ABSTRACT

Disclosed is a method of electrolyzing aqueous solutions of alkali metal chlorides such as sodium chloride brine where an electrical current is passed from an anode to the cathode, evolving chlorine at the anode and hydrogen at the cathode. According to the disclosed method the cathode has a coating containing tungsten and another transition metal. The other transition metal may be nickel or cobalt.

8 Claims, No Drawings

CATHODE ELECTROCATALYST

DESCRIPTION OF THE INVENTION

In the process of producing alkali metal hydroxide and chlorine by electrolyzing an alkali metal chloride brine, such as in aqueous solution of sodium chloride or potassium chloride, the alkali metal chloride solution is fed into the cell, a voltage is imposed across the cell, chlorine is evolved at the anode, alkali metal hydroxide is produced in the electrolyte in contact with the cathode, and hydrogen is evolved at the cathode.

The overall anode reaction is:

$$(1)\ 2Cl^- \rightarrow Cl_2 + 2e^-,$$

while the overall cathode reaction is:

$$(2)\ 2H_2O + 2e^- \rightarrow H_2 + 2OH^-.$$

More precisely, the cathode reaction is reported to be:

$$(3)\ H_2O + e^- \rightarrow H_{ads} + OH^-$$

by which the monatomic hydrogen is adsorbed onto the surface of the cathode. In basic media, the adsorbed hydrogen is reported to be desorbed according to one of two processes:

$$(4)\ 2H_{ads} \rightarrow H_2, \text{ or}$$

$$(5)\ H_{ads} + H_2O + e^- \rightarrow H_2 + OH^-.$$

The hydrogen desorption step, i.e., reaction (4) or reaction (5), is reported to be the hydrogen overvoltage determining step. That is, it is the rate controlling step and its activation energy corresponds to the cathodic hydrogen overvoltage. The hydrogen evolution potential for the overall reaction (2) is on the order of about 1.5 to 1.6 volts versus a saturated calomel electrode (SCE) on iron in basic media. Iron, as used herein to characterize the cathodes, includes iron and iron alloys such as low carbon steels and alloys of iron with manganese, phosphorous, cobalt, nickel, molybdenum, chromium, vanadium, and the like.

According to the method disclosed herein, it has been found that the hydrogen overvoltage may be reduced, for example, by from about 0.05 volt to about 0.20 volt by utilizing a cathode, for example, an iron cathode, having a surface of tungsten and another transition metal in contact with the electrolyte. The transition metal may be either cobalt or nickel.

DETAILED DESCRIPTION OF THE INVENTION

Disclosed is a method of electrolyzing aqueous alkali metal chlorides where an electrical potential is imposed across an anode and a cathode so that an electrical current passes from an anode of an electrolytic cell to a cathode of the cell. In this way, chlorine is evolved at the anode and hydrogen is evolved at the cathode. According to the disclosed method, the cathode has a surface thereon in contact with the electrolyte which surface is tungsten and another transition metal. The second transition metal may be nickel or cobalt or a mixture thereof.

Further disclosed herein is an electrolytic cell having an anode, a cathode, and an external means for imposing electrical potential between the anode and the cathode. The electrolytic cell is characterized by the cathode having a coating of tungsten and a second transition metal in contact with the electrolyte. The transition metal may be nickel or cobalt or both.

Also disclosed herein is a method of reducing the cathodic hydrogen evolution overvoltage of an iron surface used as a cathode for the evolution of hydrogen. According to the disclosed method, the iron surface is contacted with an electroless plating composition which includes a tungsten salt and a salt or salts of another transition metal chosen from the group consisting of nickel and cobalt and combinations thereof. The iron surface is maintained in contact with the electroless plating composition while hydrogen is evolved at the surface, in this way coating the iron surface with a layer containing tungsten and the transition metal. Thereafter, the iron substrate, now coated, is removed from the electroless plating solution and may be used as a cathode in contact with an electrolyte, resulting in a hydrogen overvoltage reduction of about 0.2 volt to 0.3 volt.

In the commercial electrolysis of alkali metal chlorides to yield chlorine, hydrogen, and alkali metal hydroxide, the alkali metal chloride may be sodium chloride or potassium chloride. Most commonly, the alkali metal chloride is sodium chloride and the invention will be described with respect to sodium chloride and sodium hydroxide. However, it is to be understood that the method of this invention is equally useful with potassium chloride brines, or, in fact, any process where hydrogen is evolved at a cathode under alkaline conditions.

Sodium chloride is fed to the cell as brine. The brine may be saturated brine, for example, sodium chloride brine containing from about 315 to about 325 grams per liter of sodium chloride, or an unsaturated brine containing less than about 315 grams per liter of sodium chloride, or a supersaturated brine containing in excess of 325 grams per liter of sodium chloride.

According to the method described herein, the electrolysis is carried out in a diaphragm cell. The diaphragm may, in fact, be an electrolyte permeable diaphragm, for example, as provided by an asbestos diaphragm or a resin-treated asbestos diaphragm. Alternatively, the diaphragm may be a microporous diaphragm, for example, provided by microporous halocarbon. According to still another exemplification of this invention, the diaphragm may, in fact, be a permionic membrane, substantially impermeable to the passage of electrolyte therethrough but permeable to the flow of ions therethrough.

Where the diaphragm is asbestos diaphragm, the diaphragm is most commonly prepared from chrysotile asbestos having fibers in the size range of from about 3T to about 4T, e.g., a mixture of grades 3T and 4T asbestos, as measured by the Quebec Asbestos Producers Association standard screen size. The 3T asbestos has a standard screen size of 1/16 (2 mesh), 9/16 (4 mesh), 4/16 (10 mesh), and 2/16 (pan). The 4T asbestos has a size distribution of 0/16 (2 mesh), 2/16 (4 mesh), 10/16 (10 mesh), and 4/16 (pan). The numbers within the parentheses refer to the mesh size in meshes per inch.

Permeable diaphragms, prepared as described above, allow the anolyte liquor to percolate through the diaphragm at a high enough rate that convective flow, i.e., hydraulic flow, through the diaphragm to the catholyte liquor exceeds the electrolytic flow of hydroxyl ion from the catholyte liquor through the diaphragm to the anolyte liquor. In this way, the pH of the anolyte liquor is maintained acid and the formation of the chlorate ion within the anolyte liquor is suppressed.

Where an electrolyte permeable asbestos diaphragm is used, the catholyte liquor typically contains from about 10 to about 20 weight percent sodium chloride and from about 8 to about 15 weight percent sodium hydroxide.

Alternatively, a perm-selective membrane may be interposed between the anolyte liquor and the catholyte liquor. The perm-selective membrane may be provided by a fluorocarbon or a sulfonated fluorocarbon.

Where either an electrolyte permeable diaphragm or perm-selective membrane is utilized between the anolyte liquor and the catholyte liquor, the cathode reaction has an electrical potential of about 1.1 volts and, as described above, is:

$$(2)\ 2H_2O + 2e^- \rightarrow H_2 + 2OH^-$$

which is the overall reaction for the adsorption step:

$$(3)\ H_2O + e^- \rightarrow H_{ads} + OH^-$$

and one of two alternative hydrogen desorption steps:

$$(4)\ 2H_{ads} \rightarrow H_2, \text{ or}$$

$$(5)\ H_{ads} + H_2O + e^- \rightarrow H_2 + OH^-.$$

According to the method of this invention, a cathode of reduced hydrogen overvoltage is utilized. The cathode has a metallic substrate with a coating containing tungsten and a transition metal chosen from the group consisting of cobalt, nickel, and mixtures thereof. Additionally, as where the coating is deposited from an electroless plating solution, the coating may contain phosphorous or boron.

The substrate is typically an iron substrate. As used herein, iron includes elemental iron and steel, i.e., alloys of iron with manganese, cobalt, nickel, chromium, molybdenum, vanadium, carbon, and the like.

The substrate itself is macroscopically permeable to the electrolyte but microscopically impermeable thereto. That is, the substrate is permeable to the bulk flow of electrolyte therethrough between individual elements thereof such as between individual rods or wire or through perforations, but not to the flow of electrolyte into and through the individual elements thereof. The cathode itself may be a perforated plate, expanded metal mesh, metal rods, or the like.

The coating on the cathode is provided by tungsten and another transition metal chosen from the group consisting of cobalt, nickel, and mixtures thereof. Most frequently, the coating will also include small amounts of phosphorous or boron. The amount of tungsten is typically from about 5 weight percent to about 30 weight percent of the total coating and preferably from about 7 weight percent to about 15 weight percent thereof. The amount of boron or phosphorous, when present, is from about 3 weight percent to about 15 weight percent of the total coating and preferably from about 5 weight percent to about 10 weight percent thereof. The transition metal is typically from about 65 to about 92 weight percent of the total coating weight, and preferably from about 75 to about 88 weight percent thereof.

The coating typically has a thickness of in excess of 2 microns and preferably from about 15 to about 100 microns although greater thicknesses may be used without deleterious effect.

The coating on the cathode itself may be provided by standard electroless deposition procedures. For example, when the transition metal is nickel, the electroless deposition may be carried out under either acidic or alkaline conditions. When carried out under acidic conditions, the electroless plating solution typically includes a nickel salt, a tungsten salt, a hypophosphite, and a complexing agent and buffering agent, such as a salt of a carboxylic acid or borate or both.

Typical nickel salts useful in the method of this invention include $NiCl_2.6H_2O$ and $NiSO_4.6H_2O$. Satisfactory tungsten salts include sodium tungstate and potassium tungstate. Satisfactory complexing and buffering agents include hydroxyacetic acid, sodium citrate, sodium acetate, succinic acid, lactic acid, and propionic acid. Satisfactory hypophosphites include sodium hypophosphite and sodium pyrophosphite. Preferably, a electroless deposition is carried out at a pH of from about 4 to 8 and perferably at a pH of about 7. The temperature of the composition is generally from about room temperature, i.e., about 27° C., up to the reflux temperature of the composition.

Where the transition metal is cobalt, electroless deposition is typically carried out in an alkaline electroless plating solution containing a cobalt salt, a tungsten salt, a reducing agent, and a complexing agent. Typically, the cobalt salt is $CoCl_2.6H_2O$ or $CoSO_4.7H_2O$, the reducing agent is sodium hypophosphite or sodium pyrophosphite, the complexing agent is sodium citrate, ammonium chloride is present in the solution, and the pH is maintained basic.

Alternatively, the electroless deposition may be carried out in a borohydride solution or an amine boron solution. Amine boron solutions are especially desirable when the substrate is stainless steel. According to another alternative exemplification, the solution may be a borohydride solution where a catalytic amount of sodium borohydride or potassium borohydride is present in the solution.

Typically, the substrate or cathode to be electrolessly coated is placed in the electroless coating composition, the pH of the composition is adjusted until satisfactory hydrogen evolution is observed and deposition is continued for about 5 to about 25 minutes whereby to obtain a coating of satisfactory thickness.

Particularly desirable results are obtained if the iron substrate is first sensitized as with nickel or palladium before the electroless deposition of a cobalt-tungsten coating or with palladium before the electroless deposition of a nickel-tungsten coating.

After the electroless deposition, the coated substrate may be heated to a temperature of from about 350° C. to about 550° C.

The electrode so prepared may then be used as the cathode in an electrolytic cell having an anode and a cathode. Most frequently, the anode is a metal anode, for example, a valve metal anode, with an electrocatalytic coating thereon. Valve metals are those metals which form an oxide film when exposed to acidic media under anodic conditions. The valve metals, also referred to as "film forming metals" include titanium, tantalum, tungsten, niobium, and vanadium. Alternatively, the substrate may be silicon. The anode coating is typically an oxide of titanium, tungsten, tantalum, niobium, or vanadium, with an oxide of a platinum group metal such as palladium, rhodium, ruthenium, osmium, iridium, or platinum. One particularly desirable coating is a ruthenium dioxidetitanium dioxide coating where both the ruthenium dioxide and titanium dioxide are in the rutile crystal form. Additionally, a small amount of an activating agent such as tin, arsenic, antimony, or bismuth may be present in the coating. In such a cell, the cathode is as described hereinabove.

The cell body is preferably a metal cell body rather than the concrete cell body of the prior art cells. In this way, the electrolyte is substantially free of cementitious products, e.g., calcium compounds. The electrolytic cell may further include a membrane between the anode and cathode, such as an asbestos diaphragm or an organic resin film. Means are provided in combination with the electrolytic cell to impose an electrical potential across the anode and the cathode whereby to cause an electrical current to pass therebetween, evolving chlorine at the anode and hydrogen at the cathode.

Cathodes prepared according to the method of this invention typically have a hydrogen evolution potential of from about 1.2 to about 1.4 volts versus a saturated calomel electrode (SCE) in alkaline media while conventional iron cathodes have a hydrogen overvoltage of from about 1.5 to about 1.57 volts versus a saturated calomel electrode (SCE) under the same conditions. In this way, a voltage savings of from about 0.2 volt to about 0.3 volt is obtained when the current density is approximately 190 amperes per square foot.

The following examples are illustrative.

EXAMPLE I

An iron coupon was electrolessly coated with nickel and tungsten utilized as the cathode in a laboratory electrolytic cell.

A mild steel coupon measuring 1-15/16 inch by 11/16 inch by 1/16 inch was polished. Thereafter, the coupon was inserted in a solution prepared from 12 grams of sodium citrate, 10 grams of sodium tungstate, 10 grams of nickel chloride, 10 grams of sodium hypophosphite, and 3 grams of sodium tetraborate, subsequently diluted to 1,000 grams, using distilled water. A 250 milliliter portion of this electroless plating solution was placed on a hot plate and heated to 87° C. Thereafter, the coupon was placed in the bath and the pH adjusted to 7.0. Hydrogen was seen to be evolved and dendrites formed on the coupon. The coupon was then removed from the electroless plating solution, washed, and inserted in a cell measuring 6½ inches high by 3½ inches wide by 4 inches deep. The anolyte compartment of the cell was 2 inches deep by 3½ inches wide by 6½ inches high and the catholyte compartment was 2 inches deep by 3½ inches wide by 6½ inches high. The anode was a 1½ inch by 2⅜ inch ruthenium dioxide-titanium dioxide coated titanium mesh. A duPont NAFION perfluorosulfonic acid membrane was interposed between the anolyte and the catholyte. A 1-15/16 inch by 11/16 inch by 1/16 inch uncoated mild steel cathode was also in the cell. It was possible to use either of the cathodes alternately. Electrolysis was conducted over a period of 18 days at a cathode current density of 190 amperes per square foot at a temperature of 25° C. The initial cathodic hydrogen evolution potential on the coated perforated plate was 1.29 to 1.32 volts versus a saturated calomel electrode (SCE). After an initial break-in period, the hydrogen evolution potential of the coated cathode varied between about 1.22 and 1.30 volts versus a saturated calomel electrode (SCE). At the termination of the run, the hydrogen evolution potential was 1.30 volts versus a saturated calomel electrode (SCE).

The uncoated perforated iron plate cathode had a hydrogen evolution potential of 1.52 volts versus a saturated calomel electrode after one day in the cell and varied between 1.48 1.57 volts versus a saturated calomel electrode over the 18 days of electrolysis.

EXAMPLE II

A steel plate was coated with cobalt and tungsten and utilized as the cathode in a laboratory electrolytic cell. The electroless plating solution was prepared from 20 grams of sodium citrate, 12 grams of sodium tungstate, 4 grams of cobaltous chloride, 30 grams of sodium hypophosphite, and 4.0 grams of sodium tetraborate which was then diluted to 1,000 milliliters with distilled water and maintained at a pH of 9.0 to 9.5. A perforated steel plate of the same size as that described in Example I was inserted in the electroless plating bath and held there until a satisfactory coating had formed. Thereafter, the coated plate was removed from the bath, rinsed, and inserted in a laboratory electrolytic cell as described in Example I hereabove. Electrolysis was then commenced at a current density of 190 amperes per square foot for a period of 7 days during which time the cathodic hydrogen evolution potential varied from about 1.31 to about 1.36 volts versus a saturated calomel electrode (SCE). An uncoated iron cathode utilized as a standard had a hydrogen evolution potential of from about 1.53 to about 1.57 volts versus a saturated calomel electrode (SCE).

Other cobalt-tungsten coated steel cathodes prepared as described above had hydrogen evolution potential ranging from 1.27 to 1.54 volts versus a saturated calomel electrode (SCE), with the higher overvoltages being associated with physical deterioration of the coating.

While the invention has been described with reference to particular exemplifications and embodiments thereof, the scope is not to be so limited except as in the claims appended hereto.

I claim:

1. In a method of electrolyzing an aqueous alkali metal chloride which method comprises passing an electrical current from an anode to a cathode, evolving chloride at said anode and evolving hydrogen at said cathode at a hydrogen evolution potential, the improvement wherein said cathode has a coating thereon comprising tungsten and a transition metal chosen from the group consisting of nickel, cobalt, and mixtures thereof.

2. The method of claim 1 wherein said hydrogen evolution potential is less than 1.35 volts in aqueous sodium hydroxide-sodium chloride measured versus a saturated calomel electrode at a current density of 190 amperes per square foot and a temperature of 95° C.

3. The method of claim 1 wherein said coating contains phosphorous.

4. The method of claim 3 wherein said coating comprises from about 3 to about 15 weight percent phosphorous, from about 5 to about 30 weight percent tungsten, and balance said second transition metal.

5. In an electrolytic cell having an anode, a cathode, an external means for imposing an electrical potential therebetween, the improvement wherein said cathode has a coating thereon comprising tungsten and a second transition metal chosen from the group consisting of nickel, cobalt, and mixtures thereof.

6. The electrolytic cell of claim 5 wherein said coating contains phosphorous.

7. The electrolytic cell of claim 6 wherein said coating comprises from about 3 to about 15 weight percent phosphorous, from about 5 to about 30 weight percent tungsten, and balance said second transition metal.

8. A method of reducing the cathodic hydrogen evolution overvoltage of an iron surface comprising contacting said iron surface with an electroless plating composition comprising a tungsten salt and a salt of a transition metal chosen from the group consisting of nickel and cobalt, evolving hydrogen at the iron surface in contact with the electroless plating solution whereby to coat the iron surface with a layer comprising tungsten and a transition metal chosen from the group consisting of cobalt and nickel, removing the coated iron surface from the electroless plating solution and placing the coated iron surface as a cathode in contact with an electrolyte.

* * * * *

UNITED STATES PATENT AND TRADEMARK OFFICE

CERTIFICATE OF CORRECTION

PATENT NO. : 4,010,085

DATED : March 1, 1977

INVENTOR(S) : William W. Carlin

It is certified that error appears in the above-identified patent and that said Letters Patent are hereby corrected as shown below:

Column 6, line 46, "chloride" should be --chlorine--.

Signed and Sealed this

Third Day of May 1977

[SEAL]

*Attest:*

RUTH C. MASON
*Attesting Officer*

C. MARSHALL DANN
*Commissioner of Patents and Trademarks*